US010271582B1

(12) United States Patent
Kipchaba

(10) Patent No.: US 10,271,582 B1
(45) Date of Patent: Apr. 30, 2019

(54) BABY BIB AND METHOD OF USE

(71) Applicant: Caroline J. Kipchaba, Hobbs, NM (US)

(72) Inventor: Caroline J. Kipchaba, Hobbs, NM (US)

( * ) Notice: Subject to any disclaimer, the term of this patent is extended or adjusted under 35 U.S.C. 154(b) by 0 days.

(21) Appl. No.: 15/155,215

(22) Filed: May 16, 2016

Related U.S. Application Data

(60) Provisional application No. 62/335,476, filed on May 12, 2016.

(51) Int. Cl.
*A41B 13/00* (2006.01)
*A41B 13/10* (2006.01)
*A61J 17/00* (2006.01)

(52) U.S. Cl.
CPC ..... *A41B 13/10* (2013.01); *A61J 17/00* (2013.01)

(58) Field of Classification Search
CPC ..... A41B 13/10; A61J 17/001
See application file for complete search history.

(56) References Cited

U.S. PATENT DOCUMENTS 2,250,887 A * 7/1941 Brown ..... A41B 13/10 2/49.2
2,754,532 A * 7/1956 Kanehl ..... A41B 15/00 15/209.1
4,604,758 A * 8/1986 Grasberger ..... A41B 13/10 2/49.3
6,374,414 B1 * 4/2002 Collier ..... A41D 27/10 2/69
7,032,248 B1 * 4/2006 Gutilla ..... A41B 13/10 2/49.1

* cited by examiner

*Primary Examiner* — Anna K Kinsaul
(74) *Attorney, Agent, or Firm* — Eldredge Law Firm, LLC; Richard Eldredge; Beth Felix

(57) ABSTRACT

A baby bib includes a body forming an opening to receive a neck of an infant; a pacifier attachment secured to a front surface of the body; and a fastener secured to the pacifier attachment. The pacifier attachment includes a base and an elongated strap integral with the base.

2 Claims, 3 Drawing Sheets

BABY BIB AND METHOD OF USE

BACKGROUND

1. Field of the Invention

The present application relates generally to baby bibs, and more specifically, for a baby bib having an attachment device for a pacifier, teether, rattles, or other suitable baby accessories.

2. Description of Related Art

Baby bibs are well known in the art and are effective means to protect the baby's cloths from food/liquid during use. In some scenarios, the baby bib is commonly used with a pacifier, teether, rattles, or other baby accessories, wherein the accessory is secured directly to the body of the baby bib. For example, FIGS. 1A and 1B are front views of a baby bib 101 associated with a pacifier 103 and means for securing the pacifier to the body of the baby bib.

Baby bib 101 includes a body 105 having two straps 107, 109 that form an opening 111 for receiving the neck of the baby therein. The two straps are secured together via a fastening device 113, e.g., a hook-loop fastener secured to each end of the two straps. The baby pacifier 103 is provided with a pacifier strap 113 secured to a quick-release device 115. During use, the quick-release device is manipulated such that the device secures the pacifier to the body of the bib, as shown in FIG. 1B.

One of the problems commonly associated with the bib and pacifier arrangement is the burden of securing the quick-release device 115 to the body of the bib. In some embodiments, the quick-release device includes a clip that is burdensome to open. An additional problem is that the pacifier attachment occasionally gets misplaced since it is detachable. Also, the pacifier sometimes gets easily pulled out by the baby. Accordingly, there is a need for a better bib that accommodates pacifiers, teethers, rattles, or other suitable baby accessories secured thereto.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1A:
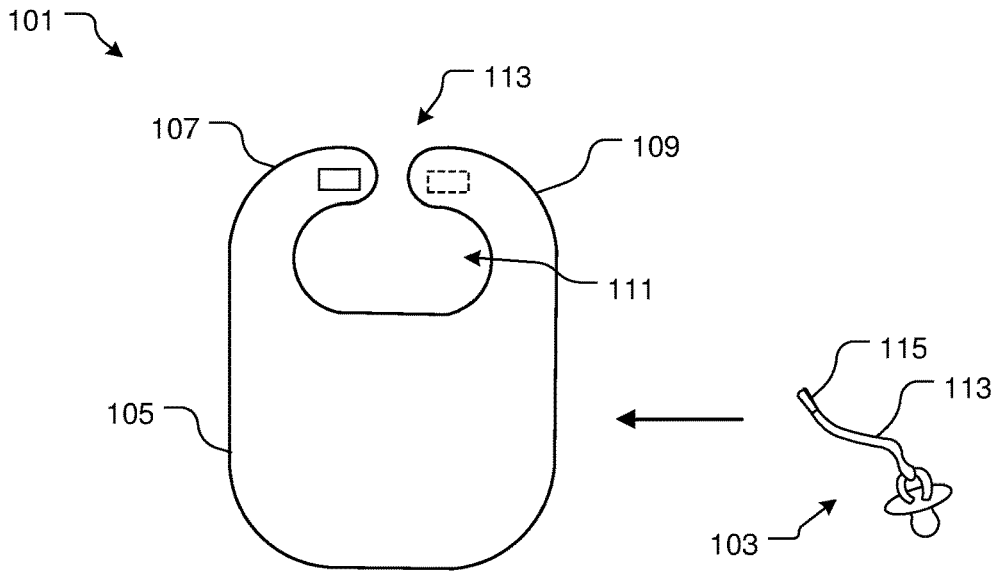
FIG. 1A (Prior Art)
FIGS. 1A and 1B are front views of a conventional baby bib and pacifier.
Figure 1B:
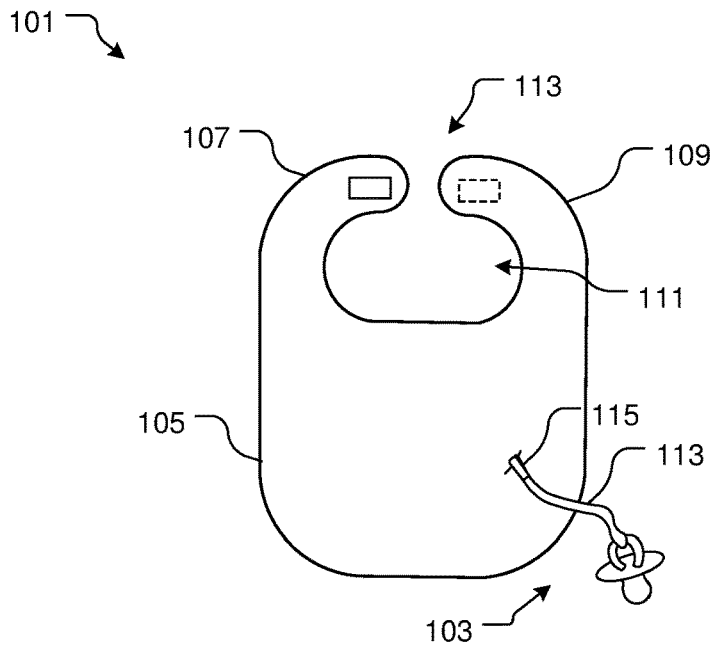
FIG. 1B (Prior Art)
Figure 2:
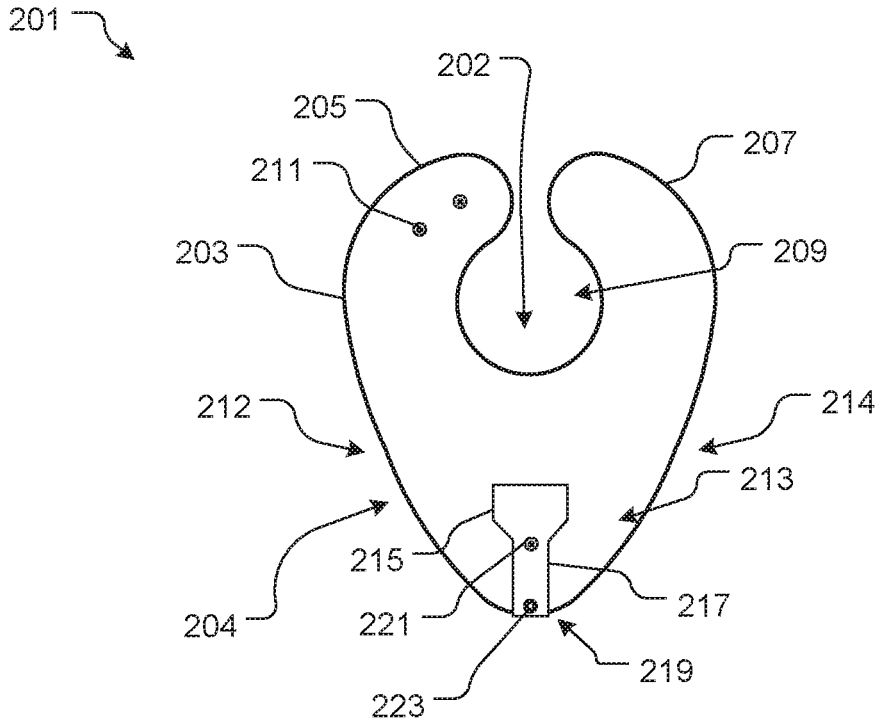
FIG. 2 is a front view of the baby bib in accordance with a preferred embodiment of the present application.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the process of the present application as defined by the appended claims.

DETAILED DESCRIPTION OF THE PREFERRED EMBODIMENT

Illustrative embodiments of the system and method of use are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use of the present application will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

Referring now to the drawings wherein like reference characters identify corresponding or similar elements throughout the several views, FIGS. 2-4B depict various views of a baby bib 201 in accordance with a preferred embodiment of the present application. It will be appreciated that bib 201 overcomes one or more of the problems commonly associated with conventional baby bibs and means of attaching a pacifier and/or teether as discussed below and shown in the accompanying drawings.

Baby bib 201 includes a body 203 with two integral straps 205, 207 extending therefrom and forming an opening configured to receive the neck of the baby therein. The opening forming an inner periphery 202 of the body, and the body further including an outer periphery 204 surrounding the inner periphery. The two straps 205, 207 are secured together via a locking device 211. In the exemplary embodiment, the locking device 211 is a snap; however, it will be appreciated that alternative embodiments could include clips, hook-loop fasteners, and the like in lieu of the preferred embodiment.

Figure 3:
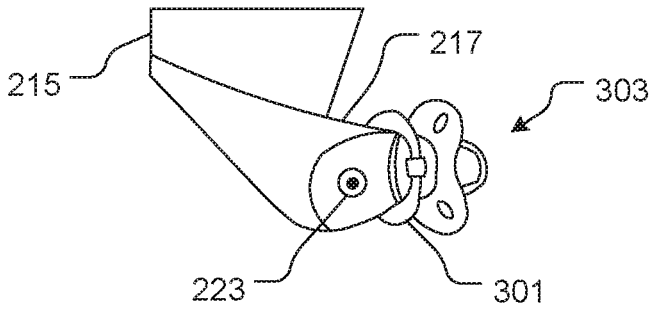
FIG. 3 is an oblique view of the pacifier attachment of the baby bib of FIG. 2.

One of the unique features believed characteristic of the present invention is the use of a pacifier attachment 213 configured to secure a pacifier 303 to the body 203 of the bib. The pacifier attachment 213 being positioned equidistance from a first edge 212 and a second edge 214 of the body and terminating at the outer periphery 204. To achieve this feature, it is contemplated having an attachment 213 with a base 215 fixedly secured to body 203 and integral with a strap 217 that extends therefrom. As shown, a fastener 219 includes two snaps 221 and 223 that are secured to the strap 217 and are configured to secure the strap 217 to the body of the bib, as shown in FIGS. 4A and 4B, and configured to removably secure the pacifier 303 to the strap 215 via the pacifier loop 301, as shown in FIG. 3.

During use, the strap 217 is disengaged from the body 203 and wrapped within the loop 301. Thereafter, the strap 217 is secured onto itself via snaps 221 and 223, as shown in FIG. 3. Although contemplated as a snap, it will be appreciated that alternative embodiments could include clips, hooks, magnets, hook-loop, and/or other similarly suitable devices.

Figure 4B:
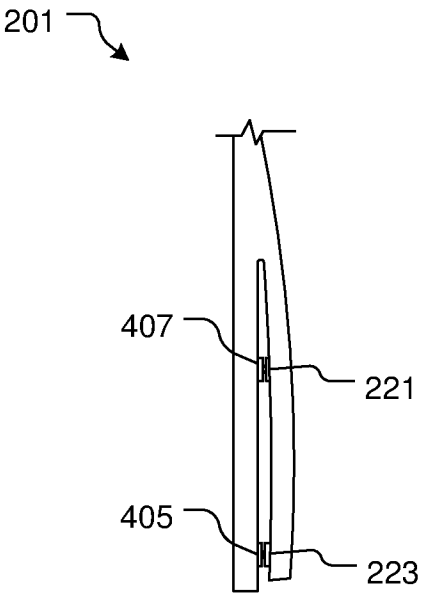
FIGS. 4A and 4B are partial side views of the baby bib and the pacifier attachment device.
Figure 4A:
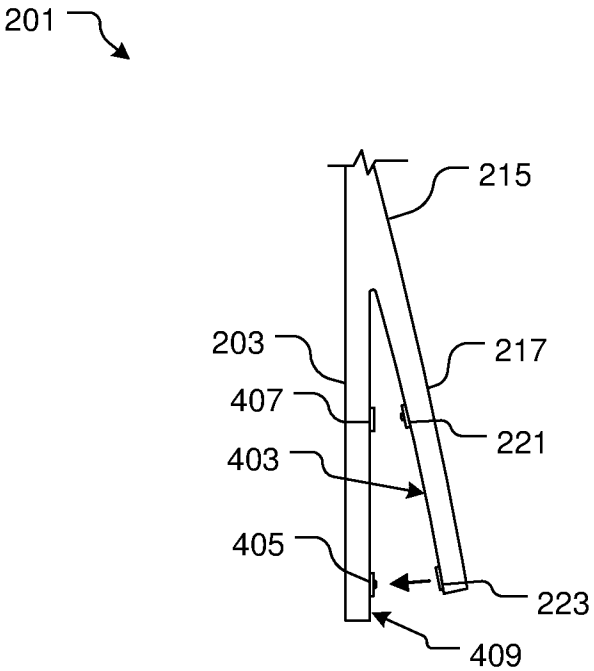

In FIGS. 4A and 4B, side views of the attachment 213. In the preferred embodiment, the snaps 221 and 223 are secured to an inner surface 403 of strap 217, while a third snap 405 and a fourth snap 407 are secured to an outer surface 409 of body 203. As shown in FIG. 4B, the snaps are configured to engage with each other to secure the strap 217 to body 203. It should be understood that snap 221 includes a male snap configuration while snap 223 includes a female configuration. This feature allows the two snaps to join together to secure the pacifier to the attachment.

In one preferred embodiment, the attachment device for securing a pacifier, teether, rattles, and/or other baby accessories to the bib is fixedly secured to the bib; however, it is contemplated having an attachment device that is removably attached to the bib in an alternative embodiment.

It is apparent that a system and method of use with significant advantages has been described and illustrated. The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A baby bib, comprising:

a body forming an opening to receive a neck of an infant; the opening forming an inner periphery of the body, the body further including an outer periphery surrounding the inner periphery, a pacifier attachment secured to a front surface of the body, the pacifier attachment having:

a foldable body, having:

a base fixedly secured to the front surface of the body, the base being secured at a position equidistance from a first edge of the body and a second edge of the body, the base further being spaced from the inner periphery such that the front surface is visible between the inner periphery and the base; and an elongated strap integral with the base, the elongated strap extending from a first end to a second end, the first end forming a portion of the base, the second end aligning with and terminating at the outer periphery;

a first female snap secured to the elongated strap and positioned near the second end of the elongated strap; and a first male snap secured to the elongated strap and positioned near the first end of the elongated strap, the first male snap is configured to releasably engage with the first female snap, wherein when the first female snap is secured to the first male snap, a loop is formed via the elongated strap, which in turn secures to the pacifier;

a second male snap secured to the front surface of the body; and a second female snap secured to the front surface of the body;

wherein the second male and female snaps are vertically aligned to correspond to the first male and female snaps such that wherein the elongated strap is optionally secured in a flat orientation by securing the first female snap to the second male snap and securing the first male snap to the second female snap.

2. The baby bib of claim 1, wherein the base is removably attached to the body.

* * * * *